US011629458B2

(12) United States Patent
Peyser et al.

(10) Patent No.: US 11,629,458 B2
(45) Date of Patent: Apr. 18, 2023

(54) GARMENT WITH CUSTOMIZABLE FACE COVERING

(71) Applicant: DPI IMPORTS, INC., Bay Shore, NY (US)

(72) Inventors: Joshua Peyser, Bay Shore, NY (US); Gabriel Peyser, Bay Shore, NY (US)

(73) Assignee: DPI IMPORTS, INC., Bay Shore, NY (US)

( * ) Notice: Subject to any disclaimer, the term of this patent is extended or adjusted under 35 U.S.C. 154(b) by 9 days.

(21) Appl. No.: 17/480,994

(22) Filed: Sep. 21, 2021

(65) Prior Publication Data

US 2022/0090318 A1 Mar. 24, 2022

Related U.S. Application Data

(60) Provisional application No. 63/081,597, filed on Sep. 22, 2020.

(51) Int. Cl.

| | |
|---|---|
| ***D06P 5/00*** | (2006.01) |
| ***D06P 5/28*** | (2006.01) |
| ***D06P 3/52*** | (2006.01) |

(52) U.S. Cl.

CPC ..... *D06P 5/004* (2013.01); *D06P 3/52* (2013.01)

(58) Field of Classification Search

CPC ..... D06P 5/004; D06P 3/52
USPC ..... 8/471
See application file for complete search history.

(56) References Cited

U.S. PATENT DOCUMENTS

| | | | | |
|---|---|---|---|---|
| 7,418,740 | B2 | 9/2008 | Anderson et al. | |
| 7,467,422 | B2 | 12/2008 | Bugarin | |
| D761,524 | S | 7/2016 | Cook | |
| 9,521,873 | B1 | 12/2016 | Mignone | |
| D843,689 | S | 3/2019 | Kinnear | |
| 2006/0260025 | A1* | 11/2006 | Voege | A41D 1/04 2/269 |
| 2009/0075075 | A1* | 3/2009 | Abrams | D06Q 1/00 428/354 |
| 2012/0237740 | A1* | 9/2012 | Hefty | B82Y 30/00 977/788 |
| 2017/0055597 | A1 | 3/2017 | Lekven | |
| 2017/0079343 | A1 | 3/2017 | Chen | |

OTHER PUBLICATIONS

Andrew Asch, Hi-Tec Venture Series' Hoodie With Built-in Mask, Jun. 30, 2020, https://www.apparelnews.net/news/2020/jun/30/venture-series-hoodie-built-mask/, 3 sheets.

Adele Peters, This hoodie comes with a built-in mask, Apr. 18, 2020, https://www.fastcompany.com/90491920/this-hoodie-comes-with-a-built-in-mask, 8 sheets.

* cited by examiner

*Primary Examiner* — Eisa B Elhilo
(74) *Attorney, Agent, or Firm* — Katten Muchin Rosenman LLP

(57) ABSTRACT

Disclosed herein is a customized garment a method of forming the customized garment. The method involves first forming a garment having an integrated gaiter coupled to a neckline of the customized garment. The integrated gaiter has a customizable insert coupled to a front portion of the integrated gaiter. The integrated gaiter is stretched over a platen so that an entirety of the customizable insert is flat. Heat transfer sublimation is used to transfer imagery from sublimation paper to the customizable insert.

9 Claims, 7 Drawing Sheets

GARMENT WITH CUSTOMIZABLE FACE COVERING

CROSS-REFERENCE TO RELATED APPLICATIONS

This application claims priority to U.S. Provisional Application Ser. No. 63/081,597, filed Sep. 22, 2020, the entire contents of which are hereby incorporated by reference in their entirety.

FIELD OF THE INVENTION

The present invention discloses a garment having an integrated gaiter that can be pulled up to protect the face and mount of a user and pushed down when not in use. More particularly, the present invention discloses a garment in which the integrated gaiter having a visible section that can be can be customized with imagery selected by the user.

BACKGROUND

A number of garments currently exist in the market having integrated face protection, such as a gaiter. In some garments, the gaiter is tubular and sewn into the interior neckline of the garment. The gaiter can be pulled up for protection when needed and pushed down when no longer needed. In other garments, the face protection is sewn into a compartment in the hood or neckline and ends of the garment can be secured to the hood or neck to form a facial covering. For example, some garments have a face mask with one side coupled to a first side of a hood in a compartment that can be pulled across the face and releasably coupled to the other side of the hood. However, all the described garments only come in preconfigured styles which the user must select from. Therefore, a need clearly exists for a garment having an integrated gaiter, or other facial protection, which can be customized with imagery selected by the user.

SUMMARY

The present invention discloses a customized garment a method of forming the customized garment. The method involves first forming a garment having an integrated gaiter coupled to a neckline of the customized garment. The integrated gaiter has a customizable insert coupled to a front portion of the integrated gaiter. The integrated gaiter is stretched over a platen so that an entirety of the customizable insert is flat. Heat transfer sublimation is used to transfer imagery from sublimation paper to the customizable insert.

DETAILED DESCRIPTION

Figure 2:
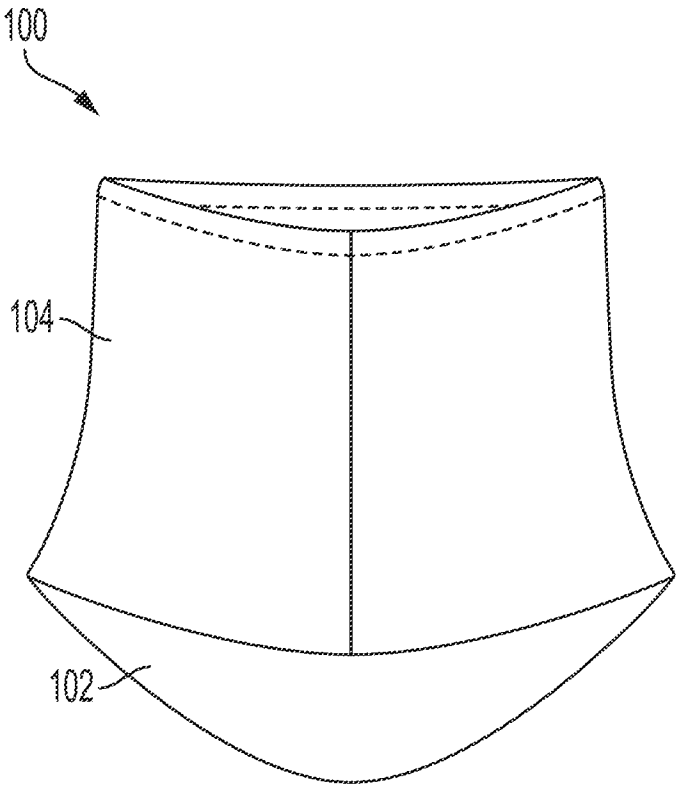
FIG. 2 depicts a rear view of the integrated gaiter in isolation.
Figure 1:
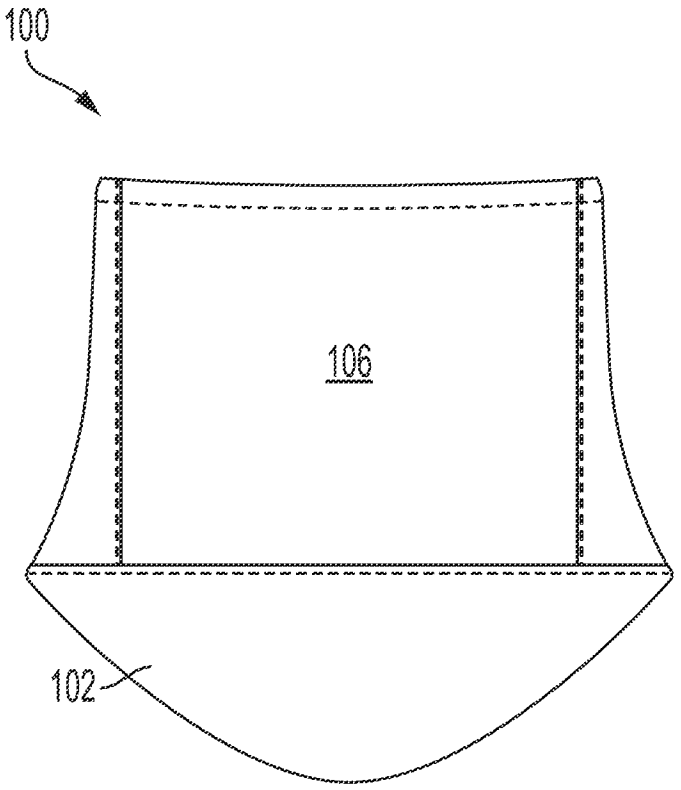
FIG. 1 depicts a front view of the integrated gaiter in isolation.

FIG. 1 depicts a front view of the integrated gaiter 100 in isolation according to a first embodiment of the invention. The integrated gaiter 100 is preferably formed in a tubular shape to fit around the head of a user. The integrated gaiter 100 is preferably formed from a two-ply material. The inner and outer materials of integrated gaiter 100 can be the same or different materials, such as cotton or a wicking material.

A bottom portion 102 of the integrated gaiter 100 is wider than upper portion 104 which fits over the face of the user. The bottom portion 102 is wider so that it can be sewn into the inner circumference of the neck opening of the garment without being seen and allows the integrated gaiter 100 to be not visible when not deployed.

The front of integrated gaiter 100 has a customizable insert 106 attached thereto. The customizable insert 106 is preferably square or rectangular and is formed from a material suitable for a heat sublimation transfer process, such as white polyester. The customizable insert 106 size is chosen such that only it is visible when integrated gaiter 100 is deployed and the hood of the garment is up. For this reason, customizable insert 106 does not have to extend around the entire circumference of integrated gaiter 100 since those portions are not typically visible.

The customizable insert 106 is preferably sewn only to the outer fabric of the integrated gaiter 100 so that the stitching does not irritate the face of the user when the integrated gaiter 100 is deployed. Customizable insert 106 may also be attached in other manners such as using adhesives, etc.

Figure 3:
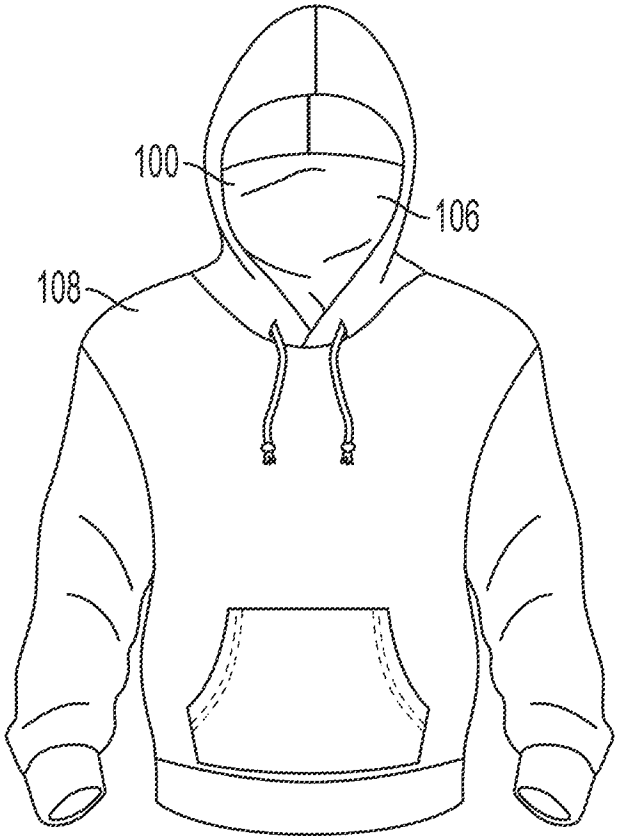
FIG. 3 depicts a view of a garment with the integrated gaiter in a deployed configuration.

FIG. 3 depicts a view of a garment 108 having integrated gaiter 100 sewn into the neckline along bottom portion 102. In this embodiment, garment 108 is preferably a basic cotton or polyester blended hooded sweatshirt. As shown, only customizable insert 106 is visible when the hood is up and integrated gaiter 100 is deployed. This reduces printing costs because the entire exterior of the integrated gaiter 100, besides customizable insert 106, can be a simple single color material without any design.

Figure 4:
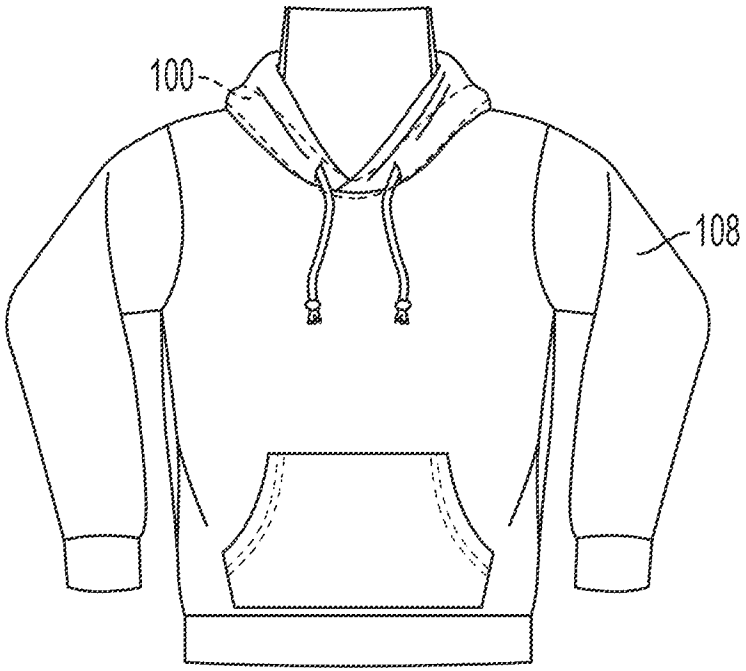
FIG. 4 depicts a view of the garment of FIG. 3 with the integrated gaiter in an undeployed configuration.

FIG. 4 depicts garment 108 when integrated gaiter 100 is undeployed and stowed in the neckline. The user simply pushes integrated gaiter 100 downward through the neck hole of the garment 108 until it is no longer visible when no face covering is desired by the user.

Figure 5:
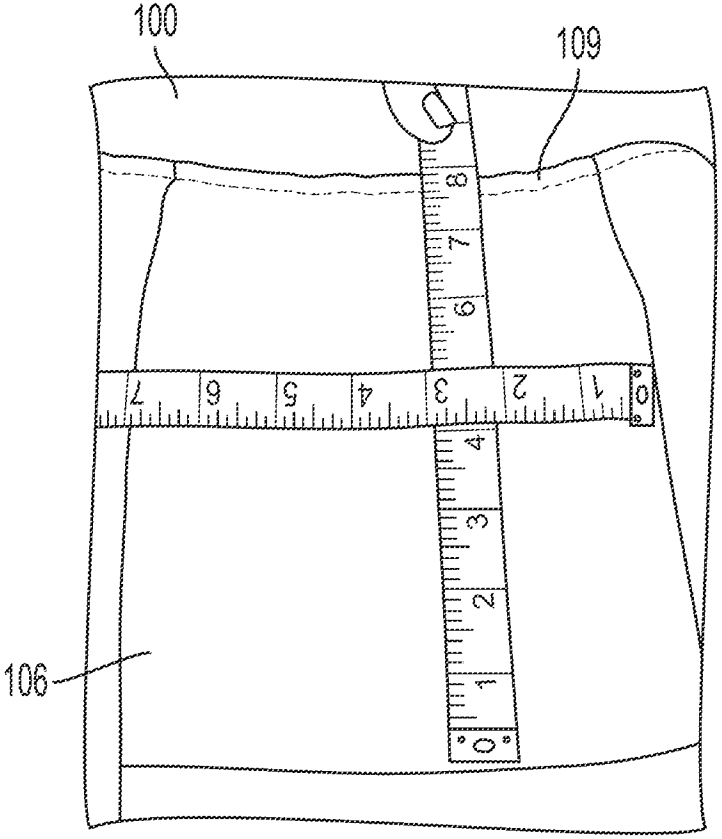
FIG. 5 depicts a front view of the integrated gaiter showing example measurements of the customizable insert.

FIG. 5 depicts sample dimensions of customizable insert 106 integrated gaiter 100 suitable for most sizes of garments 108. Preferably, customizable insert 106 is approximately 7" in width and 8" in height. Further, a top seam 109 of customizable gaiter may have an elastic thread or band to help keep the integrated gaiter 100 snug around a user's face when deployed.

A main advantage of producing garments 108 with customizable insert 106 is that the garments 108 can be made in a uniform manner with blank customizable insert 106 which later can be customized as will be described. This reduces overstock because each garment 108 can be customized with imagery by the user. In contrast, if certain patterns on integrated gaiter 100 were printed and unpopular, this would lead to overstock of those styles and reduced sales.

Figure 6:
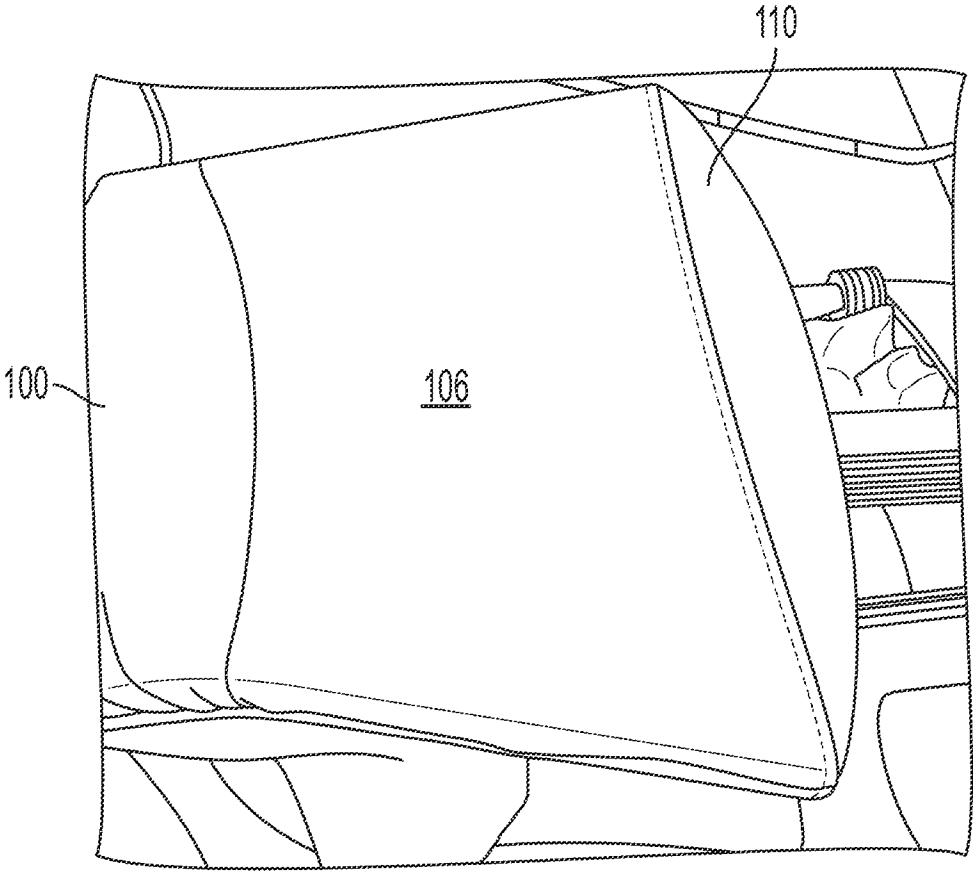
FIGS. 6-8 depict the steps used to print imagery on the customizable insert.
Figure 7:
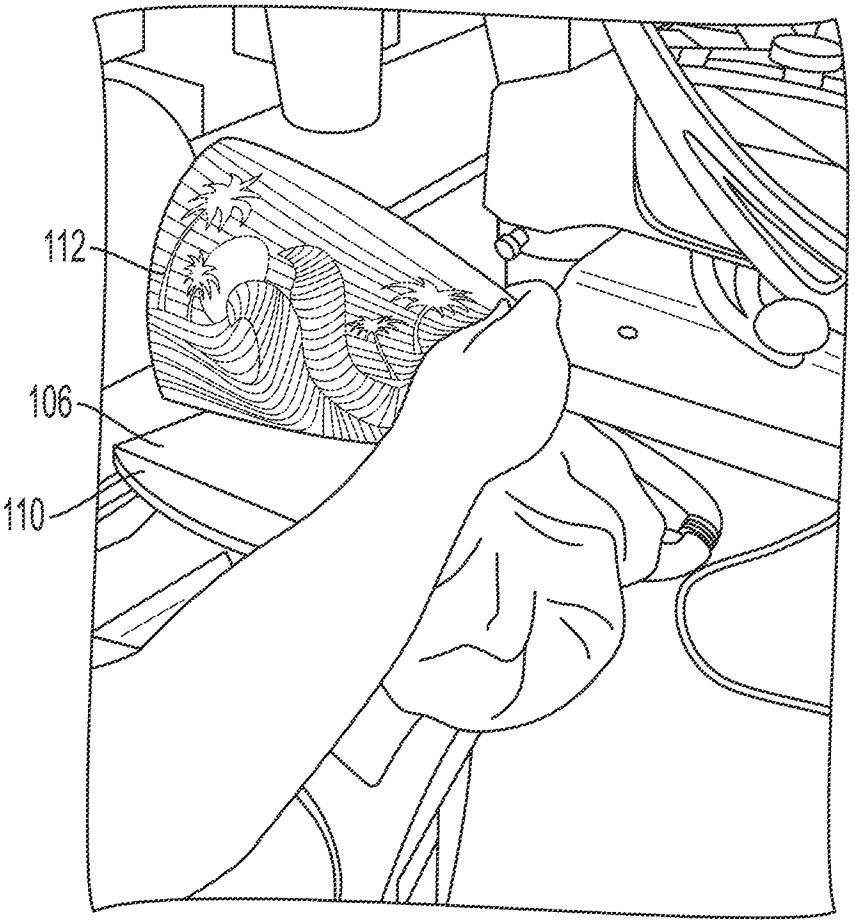
Figure 8:
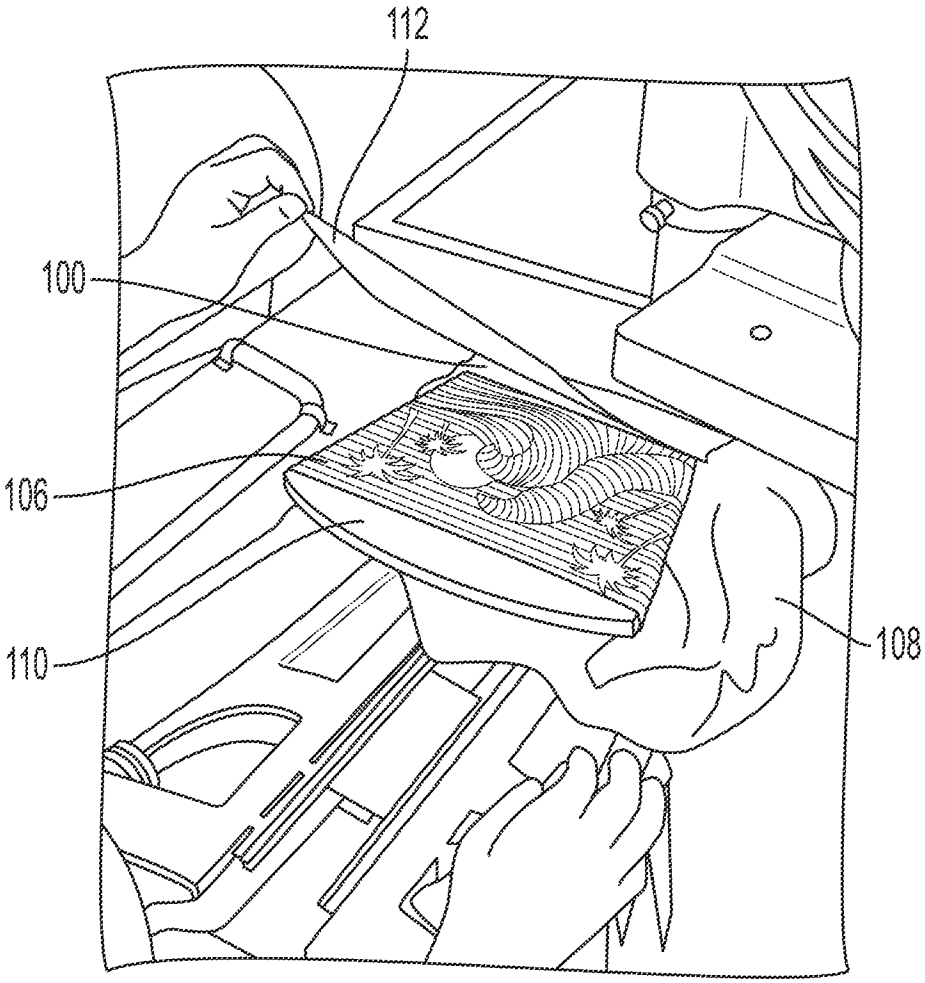

FIGS. 6-8 depict the method for printing imagery onto customizable insert 106 through a heat transfer sublimation process. Sublimation allows for full-color decoration of a piece of material such as customizable insert 106 and can be applied after garment 108 has already been fully constructed.

Sublimation works best on 100% polyester materials. For this reason, customizable insert 106 is added to the front of integrated gaiter 100 while the other sections can be made of any material. For example, the rest of integrated gaiter 100 may be made from cotton or polyester which is much more comfortable against the skin than 100% polyester. Also, the integrated gaiter 100 can be decorated after the garment 108 is sewn. Without this technique and construction, a manufacturer would have to first decorate the integrated gaiter 100 and then sew the garment 108 together, leading to increased labor and production costs.

First, as shown in FIG. 6, the integrated gaiter 100 is stretched over a custom platen 110 beneath a heat seal press such that the entirety of customizable insert 106 is stretched fully flat on top of platen 110. Next, a design chosen by the user is printed on sublimation paper 112 as shown in FIG. 7. The sublimation paper with the design is then placed on the heat seal press and heat and pressure are applied for a specific time and specific pressure. The sublimation paper 112 is then removed from customizable insert 106 as shown in FIG. 8 with the imagery having fully and permanently been transferred to customizable insert 106.

Figure 9:
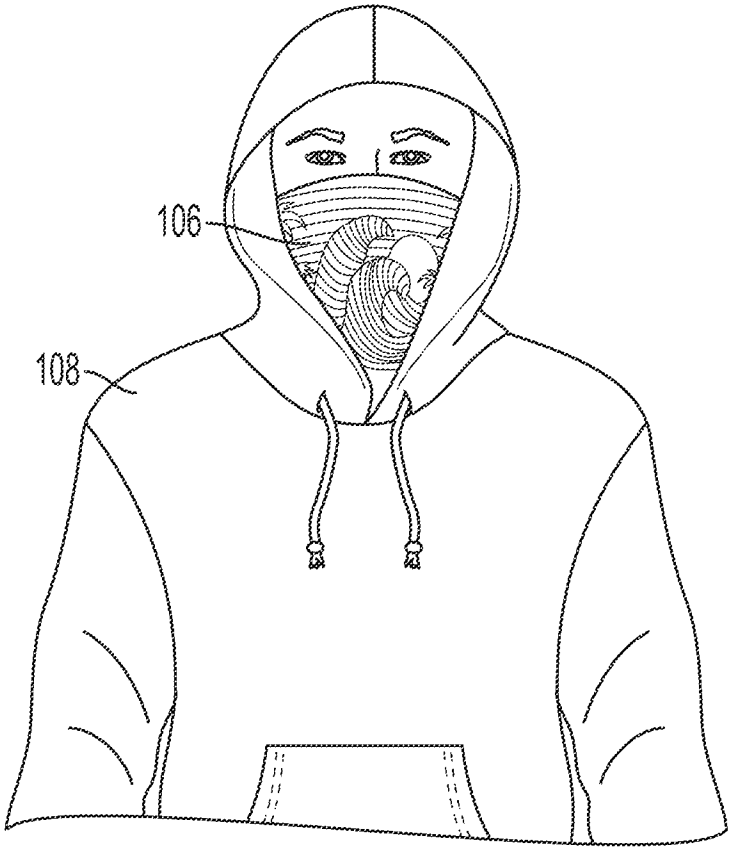
FIG. 9 depicts an example of a finished garment with imagery on the customizable insert chosen by the user.

At this point, the finished garment 108 has been produced as shown in FIG. 9. It should be apparent that this process can also be applied to other garments 108 having customizable inserts 106 applied thereto. For example, in garments 108 in which the face covering is pulled across the hood and secured to the other side, a customizable insert 106 could be coupled to the front surface and printed in a similar manner to that described with reference to FIGS. 6-8. The size/shape of customizable insert 106 may be changed due to the different configuration, but the basic methodology would remain unchanged.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the invention in diverse forms thereof. Any one or more features or functions of the first/other aspects/embodiments disclosed above may also be incorporated into the second/present aspect/embodiment, alone or in any combination.

The invention claimed is:

1. A method for producing a customized garment comprising:

forming a garment having an integrated gaiter coupled to a neckline of the garment, wherein the integrated gaiter has a customizable insert coupled to a front portion of the integrated gaiter;

stretching the integrated gaiter over a platen so that an entirety of the customizable insert is flat; and using a heat transfer sublimation process to transfer imagery from sublimation paper to the customizable insert.

2. The method of claim 1, wherein the customizable insert is formed from a different material than a body of the integrated gaiter.

3. The method of claim 2, wherein the body is formed from cotton or a wicking material.

4. The method of claim 2, wherein the customizable insert is formed from polyester.

5. The method of claim 1, wherein the customizable insert is sewn or adhered to a front of the body.

6. The method of claim 1, wherein the integrated gaiter is 2-ply.

7. The method of claim 1, wherein an upper circumference of the integrated gaiter comprises an elastic thread or band configured to secure the integrated gaiter to a face of a user.

8. The method of claim 1, wherein the heat transfer sublimation process requires applying a heat seal press to the sublimation paper for a predetermined time period at a predetermined temperature.

9. The method of claim 1, wherein only the customizable insert is visible when the integrated gaiter is deployed and a remainder of the integrated gaiter is hidden by a hood of the garment.

* * * * *